United States Patent [19]

Betts

[11] 4,040,379

[45] Aug. 9, 1977

[54] DUAL STERN DRIVE MOUNTING ARRANGEMENT

[75] Inventor: E. Douglas Betts, Gurnee, Ill.

[73] Assignee: Outboard Marine Corporation, Waukegan, Ill.

[21] Appl. No.: 685,298

[22] Filed: May 11, 1976

[51] Int. Cl.[2] ..... B63H 5/08

[52] U.S. Cl. ..... 115/37

[58] Field of Search ..... 115/37, 34 R, 38, 35, 115/41 R; 114/73

[56] References Cited

U.S. PATENT DOCUMENTS

| | | | |
|---|---|---|---|
| 906,901 | 12/1908 | Lane et al. | 115/37 |
| 1,355,513 | 10/1920 | Simpson et al. | 114/73 |
| 1,442,982 | 1/1923 | Simpson et al. | 114/73 |
| 2,972,976 | 2/1961 | Smith | 115/37 |
| 3,183,880 | 5/1965 | Shimanckas | 115/41 R |

FOREIGN PATENT DOCUMENTS

| | | | |
|---|---|---|---|
| 2,356,508 | 5/1975 | Germany | 115/37 |
| 2,207,604 | 8/1973 | Germany | 115/37 |

*Primary Examiner*—Trygve M. Blix
*Assistant Examiner*—Stuart M. Goldstein
*Attorney, Agent, or Firm*—Michael, Best & Friedrich

[57] ABSTRACT

Disclosed herein is a boat including a boat hull having a centerline, a pair of stern drive units supported by the boat hull and each including an engine, a shaft driven by the engine and having an axis of rotation extending at an angle to the boat centerline so that the axes converge in a rearward direction, a propulsion unit disposed rearwardly of the engine and including a propeller driven by the shaft, and a unit supporting the propulsion unit for steering movement relative to the boat hull.

5 Claims, 2 Drawing Figures

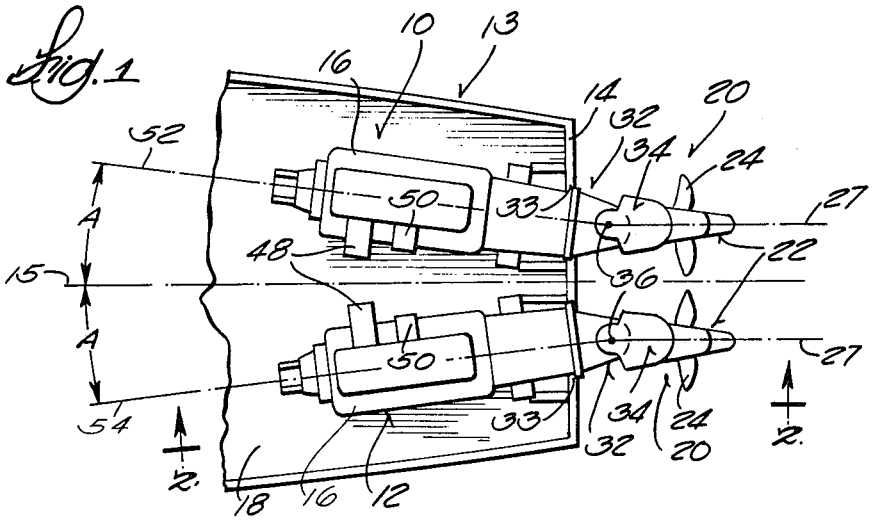
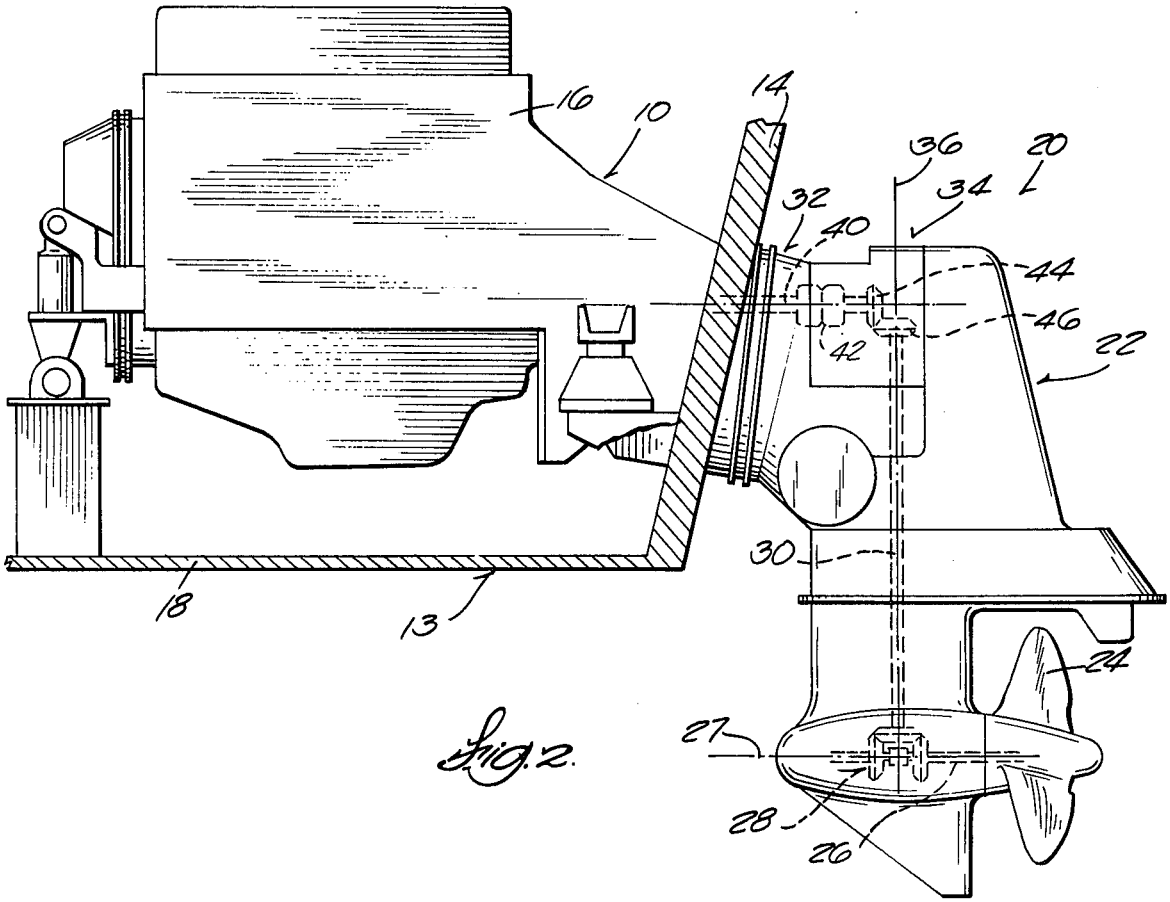
Fig. 2.

DUAL STERN DRIVE MOUNTING ARRANGEMENT

BACKGROUND OF THE INVENTION

This invention relates to marine propulsion stern drive units and, more particularly, to an arrangement for mounting dual stern drive units on boats.

When dual stern drive units are employed on boats, it is desirable to mount a propulsion units thereof as close together as possible in order to minimize the tendency of the outside propeller to lift the ventilate when sharp turns are being executed. The proximity between the two stern drive units ordinarily is limited by the available clearance between accessories, such as carburetors, recirculaton water pumps, etc., hanging on the inner sides of the powerhead or engines of the units.

SUMMARY OF THE INVENTION

The invention provides a boat comprising a boat hull having a centerline, a pair of stern drive units supported by the boat hull and each including an engine, a shaft driven by the engine and having an axis of rotation extending at an angle to the boat centerline so that the axes converge in a rearward direction, a propulsion unit disposed rearwardly of the engine and including a propeller driven by the shaft, and means supporting the propulsion unit for steering movement relative to the boat hull.

In accordance with one embodiment, the invention provides a boat including a hull having a transom and a longitudinally extending centerline, a pair of stern drive units each including an engine disposed forwardly of the boat transom, a propulsion unit disposed rearwardly of the boat transom and having a drive shaft, a propeller shaft, a propeller mounted on the propeller shaft for rotation about an axis and means drivingly connecting the drive shaft to the propeller shaft, a power shaft operatively connecting the engine with the propulsion unit drive shaft, and means supporting the propulsion unit for steering movement relative to the boat hull about a steering axis. Each stern drive unit has a longitudinal axis extending through the engine and intersecting the respective steering axis and means are provided for mounting the stern drive units on the boat hull on the opposite sides of the boat centerline with the longitudinal axis of each stern drive unit disposed at an angle to the boat centerline and converging in a rearward direction. The propulsion units can be turned a corresponding angle relative to the boat centerline so that the propeller axes are substantially parallel to each other and are substantially parallel to the boat centerline when the propulsion units are in a position for propelling the boat in a straight line.

One of the principal features of the invention is the provision of a boat mounting arrangement for dual marine propulsion stern drive units whereby the propellers of the propulsion units thereof are located close together so as to minimize the tendency of the outside propeller to lift and ventilate when sharp corners are being executed.

Another of the principal features of the invention is the provision of such a boat mounting arrangement whereby the longitudinal axes of the respective engines of each stern drive units are disposed at an angle to the longitudinal centerline of the boat with the axes converging in a rearward direction and whereby the propulsion unit of the respective stern drive units is turned a corresponding angle relative to the boat centerline so that the propeller axes thereof are substantially parallel to each other and are substantially parallel to the boat centerline when the propulsion units are in a position to propel the boat in a straight line.

Other features and advantages of the embodiments of the invention will become apparent upon reveiwing the following detailed description, the drawing, and the claims.

BRIEF DESCRIPTION OF THE DRAWING

FIG. 1 is a fragmentary, top plan view, partially in schematic, of dual stern drive units mounted on a boat in accordance with the invention.

FIG. 2 is a sectional elevational view taken along the line 2—2 in FIG. 1.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

GENERAL DESCRIPTION

Shown in the drawing is a pair of marine propulsion stern drive units 10 and 12 mounted on a boat 13 having a transom 14. The stern drive units 10 and 12 are located on the opposite sides of the longitudinal centerline 15 of the boat 13 and each includes an engine 16 which is mounted on the boat hull 18 forwardly of the transom 14 and a stern drive leg or propulsion leg 20 which is fixedly attached to the engine and includes a lower or propulsion unit 22. Each propulsion unit 22 includes a propeller 24 carried on a propeller shaft 26 which is rotatably supported for rotation about a generally horizontal axis 27 (when the propulsion unit 22 is in the propelling position) and which is driven by a drive gear 28 located on the lower end of a drive shaft 30 rotatably mounted in the propulsion unit 22. Each propulsion unit 22 is tiltable vertically, as well as horizontally swingable, relative to the respective engine 16.

While various propulson leg constructions can be used, in the preferred construction illustrated, each propulsion leg 20 is constructed generally in accordance with the Shimanckas, U.S. Pat. No. 3,183,880, issued May 18, 1965, which patent is incorporated herein by reference. As used herein, the terms "stern drive leg" and "propulsion leg" encompasses the intermediate unit A, the swivel support C and the propulsion unit B disclosed in the above-identified Shimanckas patent, which assemblies or units are designated generally in the present drawing by the reference numerals 32, 34 and 22, respectively.

Each propulsion unit 22 is carried on the respective swivel bearing support 34 for relative steerable movement about a generally vertical axis 36 provided by axially aligned bearings (not shown and corresponding to bearings 37 and 49) in FIGS. 3, 4 and 14 of the above-identified Shimanckas patent). Each swivel bearing support 34 is carried by the respective intermediate unit 32 for relative vertical tilting movement. Reference is made to the paragraph bridging columns 3 and 4 of the above-identified Shimanckas patent for a more detailed description of the coacting components of the propulsion unit 22, the swivel bearing support 34 and the intermediate unit 32 providing the steering and tilting movements.

Each intermediate unit 32 extends rearwardly through a hole 33 provided in the boat transom 14 and is fixedly supported from the boat transom 14 through elastomeric cushions or mounts (numerals 21 and 25 in the above-identified Shimanckas patent) and is fixedly attached to the respective engine 16.

Rotatably mounted within each intermediate unit 32 is a power shaft 40 which is operatively connected at one end to the respective engine crankshaft (not shown) and is drivingly connected at the other end to the respective drive shaft 30 via gear-type universal fittings 42 (corresponding to fittings 73 and 76 in the above-identified Shimanckas patent) and a beveled gear 44 which meshes with another beveled gear 46 carried on the upper end of the drive shaft 30.

Carried on the inner side of each engine 16 are laterally inwardly protruding accessories, such as one or more carburetors 48 and a recirculation water pump 50 (both shown schematically in FIG. 1). These protruding accessories effectively limit how close the two engines 16 can be mounted to each other since some clearance must be left therebetween to provide access for maintenance and servicing.

In accordance with one embodiment of the invention, the stern drive units 10 and 12 are munted on the boat hull 18 at an angular relationship to each other. More specifically, the stern drive units 10 and 12 are located so that the respective longitudinal axes 52 and 54 (extending through the respective engine 16 and intermediate unit 32 and intersecting the respective steering axis 36) is located at an angle relative to the longitudinal centerline 15 of the boat 12 and these axes converge in a rearward direction. With this arrangement, the forward or engine ends of the stern drive units 10 and 12 are effectively spaced further apart than the rear or drive ends thereof. Thus, while the minimum clearance between the accessories carried on the engines 16 of the stern drive units 10 and 12 is maintained, the two propulsion units, and thus, the two propellers 24, are located closer together than would be possible if the longitudinal axes 52 and 54 of the stern drive 10 and 12 were generally parallel to each other and to the boat centerline 15 as is the case in conventional constructions. For example, by mounting the stern drive units 10 and 12 so that the respective longitudinal axes 52 and 54 is located at an angle (represented by A in FIG. 1) of about 10°, the two propellers 24 can be located about 5 inches closer than with some conventional installations.

To compensate for the angular relationship of the stern drive units 10 and 12, each of the propulsion units 22 preferably is turned a corresponding angle relative to the boat centerline 15 so that the propeller axes 27 thereof are substantially parallel to each other and are substantially parallel to the boat centerline 15 when the propulsion units are in a position to propel the boat 12 in a straight line as shown in FIG. 1.

While the stern drive units 10 and 12 preferably are mounted so that the respective longitudinal axes 52 and 54 are located at the same angle to the boat centerline as shown in FIG. 1, they can be mounted at different angles if desired. In that case, each of the propulsion units 22 is turned an appropriate angle relative to the boat centerline 15 so that the propeller axes 27 thereof are substantially parallel to each other and to the boat centerline 15 when the propulsion units 22 are in a position to propel the boat 13 in a straight line.

From the above description, it can be seen that one embodiment of the invention provides a simple and effective means for minimizing propeller ventilating during sharp turns without requiring structural modifications to existing stern drive constructions and only minor modifications to existing mounting arrangements.

Instead of mounting the engines 16 and the intermediate units 32 at an angle to the boat centerline as in the embodiment illustrated and described in detail, it is within the scope of the invention to mount the engines generally parallel to each other or in any other conventional manner and arrange the shafts drivingly connecting the respective engines and propulsion units, such as the power shafts 40, at generally the same angular relationship described above.

Various of the features of the invention are set forth in the following claims.

What is claimed is:

1. A boat comprising a boat hull having a centerline, and a pair of stern drive units supported by said boat hull and each including an engine, a shaft driven by said engine and having an axis of rotation extending at an angle to the boat centerline so that said axes converge in a rearward direction, a propulsion unit disposed rearwardly of said engine and including a propeller driven by said shaft, and means supporting said propulsion unit for steering movement relative to said boat hull, said propellers having rotary axis substantially parallel to each other and substantially parallel to the boat centerline when said propulsion units are in position for propelling said boat in a straight line.

2. A boat according to claim 1 wherein said drive shaft axes are located at the same angle to the boat centerline.

3. A boat comprising a boat hull having a transom and a longitudinally extending centerline, a pair of stern drive units each including an engine disposed forwardly of said boat transom, a propulsion unit disposed rearwardly of said transom and having a drive shaft, a propeller shaft, a propeller mounted on said propeller shaft for rotation about an axis, and means drivingly connected said drive shaft to said propeller shaft, a power shaft operatively connecting said engine with said propulsion unit drive shaft, and means supporting said propulsion unit for steering movement relative to said boat hull about a steering axis, each of said stern drive units having a longitudinal axis extending through said engine and intersecting the respective steering axis, and means mounting said stern drive units on said boat hull on the opposite sides of the boat centerline with said longitudinal axes disposed at an angle to the boat centerline and converging in a rearward direction, said propeller axes being substantially parallel to each other and being substantially parallel to the boat centerline when said propulsion units are in position for propelling said boat in a straight line.

4. A boat according to claim 3 wherein said longitudinal axes of said stern drive units are located at the same angle to the boat centerline.

5. A boat comprising a boat hull having a transom and a longitudinally extending centerline, a pair of stern drive units each including an engine disposed forwardly of said boat transom, an intermediate unit mounted on and extending rearwardly from said engine, a propulsion unit disposed rearwardly of said intermediate unit and having a drive shaft, a propeller shaft, a propeller mounted on said propeller shaft for rotation about an axis, and means drivingly connecting said drive shaft to said propeller shaft, a power shaft operatively connected to said engine and extending rearwardly through said intermediate unit, means operatively connecting said power shaft with said propulsion unit drive shaft, and means supporting said propulsion unit for steering movement relative to said intermediate unit about a steering axis, each of said stern drive units having a longitudinal axis extending through said engine and said intermediate unit and intersecting the respective steering axis, an opening in said boat transom for receiving each of said intermediate units, and means mounting said stern drive units on said boat hull on the opposite sides of the boat centerline with said longitudinal axes disposed at an angle to the boat centerline and converging in a rearward direction, said propeller axes being substantially parallel to each other and being substantially parallel to the boat centerline when said propulsion units are in a position for propelling said boat in a straight line.

* * * * *

UNITED STATES PATENT AND TRADEMARK OFFICE

CERTIFICATE OF CORRECTION

PATENT NO. : 4,040,379

DATED : August 9, 1977

INVENTOR(S) : E. Douglas Betts

It is certified that error appears in the above-identified patent and that said Letters Patent are hereby corrected as shown below:

Column 1, line 12 "the" second occurrence should be -- and --.

Column 1, line 65 "units" should be ---unit---.

Column 3, line 29 "munted" should be ---mounted---.

Column 4, lines 43 and 44 "connected" should be ---connecting---.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*